United States Patent [19]

Colby

[11] Patent Number: 4,684,170

[45] Date of Patent: Aug. 4, 1987

[54] FOLDABLE CHAISE LOUNGE

[75] Inventor: Donald B. Colby, Sarasota, Fla.

[73] Assignee: Lee L. Woodard, Inc., Owosso, Mich.

[21] Appl. No.: 689,872

[22] Filed: Jan. 9, 1985

[51] Int. Cl.[4] ..... A47C 4/44

[52] U.S. Cl. ..... 297/19; 5/114; 5/312; 108/132; 248/188.6; 248/188.91; 297/22; 297/377; 297/441; 403/391

[58] Field of Search ..... 297/377, 51, 16, 19, 297/21, 22, 441; 108/129, 130, 131, 132, 133; 403/391, 397; 248/188.91, 188.6, 165; 5/110, 112, 114, 312

[56] References Cited

U.S. PATENT DOCUMENTS

| | | | |
|---|---|---|---|
| 36,441 | 9/1862 | Skinner . | |
| 161,234 | 3/1875 | Howe . | |
| 581,589 | 4/1897 | Houghton | 108/132 |
| 659,308 | 10/1900 | Lemmons et al. | 5/312 X |
| 749,571 | 1/1904 | Marrett | 108/132 |
| 851,724 | 4/1907 | Wood . | |
| 1,185,181 | 5/1916 | Collins . | |
| 1,630,102 | 5/1927 | Zimmerman | 108/133 |
| 1,723,796 | 8/1929 | Magnuson | 108/131 |
| 2,728,376 | 12/1955 | Halde | 297/22 |
| 2,963,761 | 12/1960 | Haydock | 248/165 X |
| 2,990,007 | 6/1961 | Kessler . | |
| 3,491,705 | 1/1970 | Blanke . | |
| 3,669,491 | 6/1972 | Weslock | 403/391 X |
| 3,737,926 | 6/1973 | Hermanson | 297/377 X |
| 3,962,827 | 6/1976 | Chaffee | 49/397 X |
| 4,105,244 | 8/1978 | Colby | 297/441 X |
| 4,168,669 | 9/1979 | Arnoff . | |
| 4,234,226 | 11/1980 | Colby . | |

FOREIGN PATENT DOCUMENTS

| | | | |
|---|---|---|---|
| 16921 | 3/1934 | Australia | 108/131 |
| 411172 | 3/1925 | Fed. Rep. of Germany | 297/22 |
| 834041 | 11/1938 | France | 297/19 |
| 250865 | 7/1948 | Switzerland | 108/131 |
| 338571 | 7/1959 | Switzerland | 108/131 |
| 522091 | 6/1940 | United Kingdom | 108/129 |

*Primary Examiner*—Kenneth J. Dorner
*Assistant Examiner*—Thomas A. Rendos
*Attorney, Agent, or Firm*—Learman & McCulloch

[57] ABSTRACT

A chaise lounge has an open framework, main frame supported on front and back leg frame structures which are hingedly connected to the front and rear portions of the main frame. A back rest portion has a lower end hingedly connected to the main frame generally intermediate the length of the main frame and is swingable from a longitudinal position generally in the plane of the main frame to any selected one of a number of vertically inclined positions. Bale-shaped front and rear leg brace frames are hingedly connected to the main frame generally intermediate the length thereof to extend in opposite directions, and each has a connecting web portion which is engageable with and disengageable from trap members fixed on the front and rear leg frames respectively at a level below the hinged connection of the front and rear leg brace frames to the main frame. Both the front and rear leg brace frames, when disengaged, are swingable upwardly toward the main frame to a nested position, and permit the front and rear leg frames to also fold upwardly toward the main frame to nested position.

5 Claims, 11 Drawing Figures

FOLDABLE CHAISE LOUNGE

BACKGROUND OF THE INVENTION

The present invention relates to light-weight metal furniture products of the type which are employed as outside furniture around swimming pools or on patios, but which also are sufficiently rugged, and suitably attractive in appearance for use as inside furniture.

The present invention is concerned with a chaise lounge which is uniquely foldable to a more compact shape for purposes of facilitating its storage when not in use. In the past, various garden furniture and other collapsible furniture products have been proposed, as exemplified in the following U.S. Pat. Nos.

36,441
161,234
851,724
1,185,181
2,990,007
3,491,705
4,168,669
4,234,226

However, the chaise lounge which will presently be described is of a different, improved character, and intended for a different market. In the past, pool and patio furniture has not generally been foldable, because foldability was deemed inconsistent with the high quality, rigid construction desired in high grade furniture for the indicated use. In the mind of the purchasing public, foldability has tended to be equated with chaise lounges of very low price, and a construction which did not afford a very long life.

One of the first attempts to design a collapsible chaise lounge which had a high quality appearance and was rigid in construction is exemplified in my prior U.S. Pat. No. 4,234,226, wherein the seat piece was separable from the frame, and the seat piece and frame components were then separately foldable for storage purposes. The present non-separable design is completely different, as will become apparent, and provides a product which is storable in folded condition, in fact, without appearing to be.

SUMMARY OF THE INVENTION

A prime objective of the present invention is to provide a seating piece such as a chaise lounge, which will stably support the weight of the occupant in a manner associated with non-foldable furniture, while still providing a unit which is foldable to render it more easily shipped, and to facilitate its storage.

Still another object of the invention is to provide a foldable chaise lounge which is structurally sound and rigid, and does not have the appearance associated previously with folding furniture, while still being economical to manufacture for the market for which it is intended.

Still a further object of the invention is to provide a foldable chaise lounge which provides the required lateral stability and avoids the creation of localized high stress areas which result in early failure of the parts, and a consequent short useful life of the product.

Another object of the invention is to provide a light-weight chaise lounge structure which is easily transported by one person, either in engaged or folded condition.

Still another object of the invention is to design a chaise lounge in which the leg structure connects with the seat piece in such a manner that it need not be separated from the legs when the chaise lounge is to be folded and stored.

A further object of the invention is to provide an extremely comfortable chaise lounge in which the back piece assembly nests with the other components for purposes of storage and yet can be readily adjusted to various vertically tilted positions to suit the position of recline desired by the occupant.

The present invention provides a chaise lounge with an open framework main frame supported on front and back leg frame structures which are hingedly connected to the front and rear portions of the main frame. A back rest portion has a lower end hingedly connected to the main frame generally intermediate the length of the main frame and is swingable from a longitudinal position generally in the plane of the main frame to any selected one of a number of vertically inclined positions. Bale-shaped front and rear leg brace frames are hingedly connected to the main frame generally intermediate the length thereof to extend in opposite directions, and each has a connecting web portion which is engageable with and disengageable from the front and rear leg frames respectively. Both the front and rear leg brace frames, when disengaged, are swingable upwardly toward the main frame to a nested position, and permit the front and rear leg frames to also fold upwardly toward the main frame.

Other objects and advantages of the invention will be pointed out specifically, or will become apparent from the following description, when it is considered in conjunction with the appended claims and the accompanying drawings.

IN THE DRAWINGS

Figure 3:
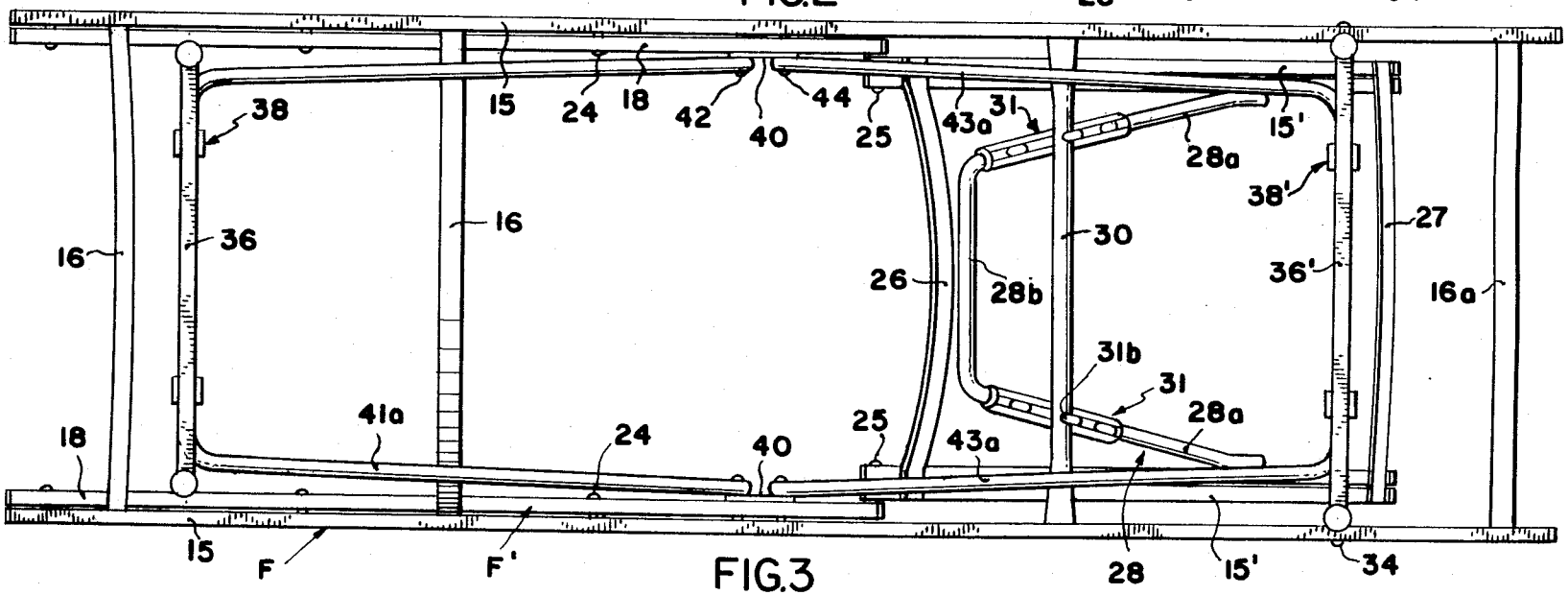
FIG. 3 is an underplan view thereof, with the fabric omitted.
Figure 5:
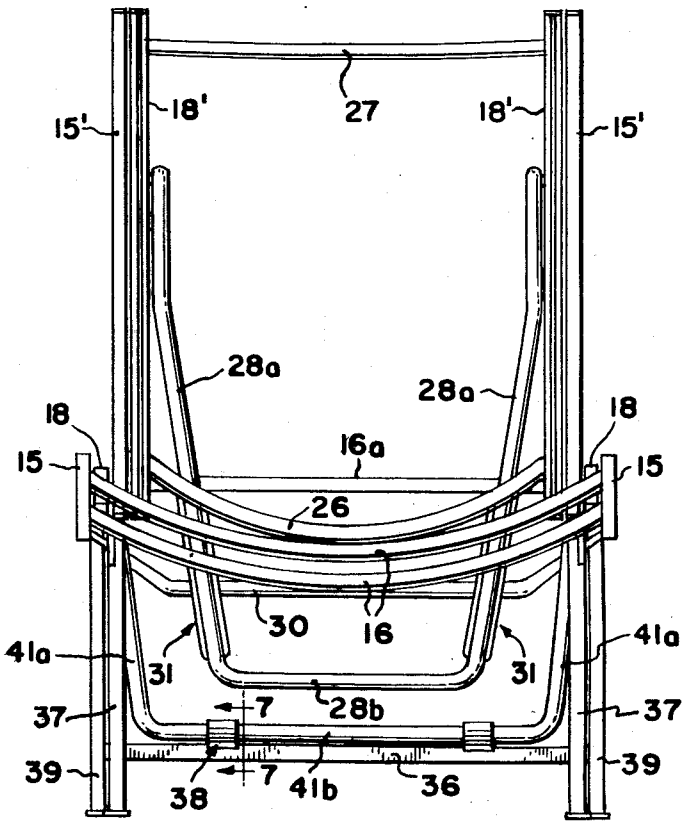
FIG. 5 is a front end elevational view taken on the line 5—5 of FIG. 1, with the fabric omitted.
Figure 4:
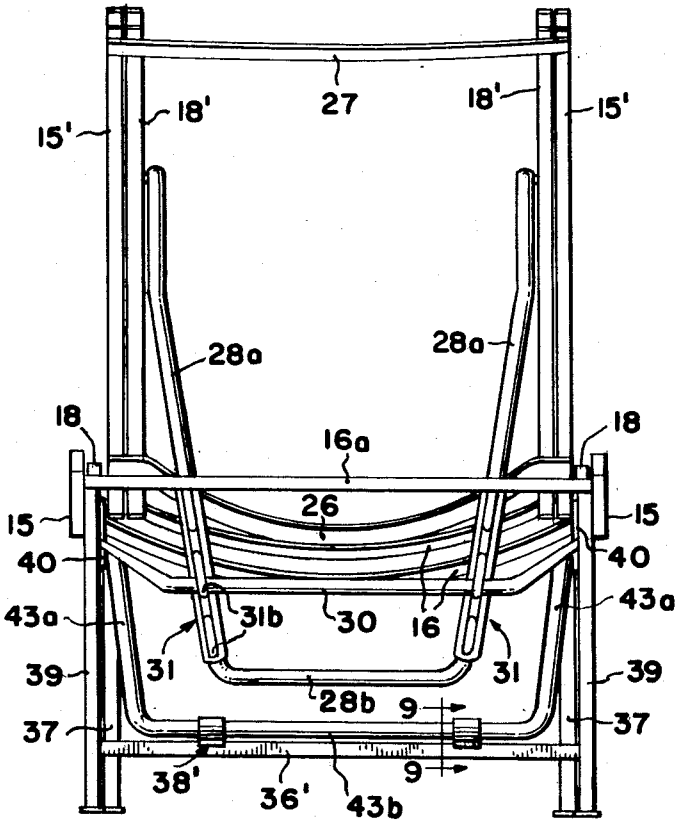
FIG. 4 is a rear end elevational view taken on the line 4—4 of FIG. 1, with the fabric omitted.

Referring now more particularly to the accompanying drawings, wherein a preferred embodiment of the invention only is disclosed, a letter F generally designates a generally longitudinally disposed, open framework, main frame, configured in a contour which provides a front, occupant's legs, support portion 12, a rear, occupant's back support portion 13, and a generally intermediate, occupant's seat, support portion 14. As FIGS. 1, 3 and 10 particularly indicate, the main frame F may be made up of tubular side rails 15 joined by downwardly arched braces 16, and a rearmost brace 16*a*. The brace members 16 and 16*a* may be welded, or otherwise secured, in position.

Figure 10:
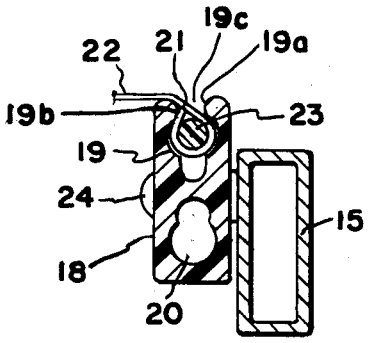
FIG. 10 is a greatly enlarged, fragmentary transverse sectional view, taken on the line 10—10 of FIG. 2.

Rigidly secured within the side rails 15 of the main frame F is an inner frame, generally designated F', which forms a part of the main frame F, and comprises a pair of side rails 18 extruded in a configuration particularly illustrated in FIG. 10 which provides a pair of keyhole-shaped slots or openings 19 and 20 therein. The uppermost opening in each side rail 18 is open to receive the welt edge 21 of the support fabric 22 which spans the rails 18 from substantially one end thereof to the other. The opening 19 in each rail 18 is narrowed at 19*a*, between overlying bead edges 19*b*, to provide a narrowed gap 19*c* of lesser width than the diameter of the preferably plastic, fore and aft extending rods 23 which, once the welts 21 are received within keyhole openings 19, may be slipped endwisely into the rails 18 through the welts formed in the edge portions of the fabric seat 22. The rails 18 may be bolted or otherwise suitably secured to rails 15 as indicated at 24, at various longitudinally spaced locations along the length of rails 18.

Hingedly connected to the rear ends of the rails 18, as by means of pins 25, is a back frame generally designated B, which is constructed in the manner disclosed in FIG. 10, and, for this reason, primed numerals have been employed to designate the previously described like parts. The back frame B employs spaced apart side rails 15' of the construction disclosed in FIG. 10, which are connected by an outwardly arched brace 26 and an end brace 27, both of which may be welded to or otherwise suitably fixed between rails 15'. Suitably bolted or otherwise secured within the frame B, and forming a part thereof, is an inner fabric supporting frame comprising rails 18' (formed in the manner disclosed in FIG. 10) which, in like manner, support the back fabric 22' which spans the rails 18' of the back B.

Figure 11:
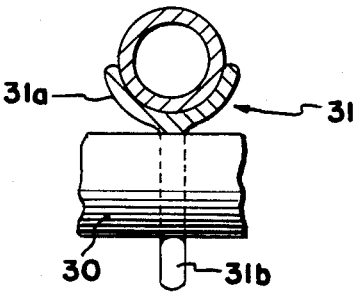
FIG. 11 is a greatly enlarged, fragmentary, transverse sectional view taken on the line 11—11 of FIG. 1.

A bale-shaped, back rest brace frame, generally designated 28, includes a pair of legs 28*a* (FIGS. 1 and 2) connected by a mid or web portion 28*b*. As FIG. 1 indicates, the upper ends of the legs 28*a* are angularly disposed and pivotally secured to the rails 18' by pins 29. Provided to span the rails 15 of the main frame F to interact with the back brace assembly 28 is a downwardly arched brace rod 30. Bolted or otherwise suitably secured to the legs 28*a* are fittings 31 which include half socket portions 31*a* (see FIG. 11), and a series of longitudinally spaced hook members 31*b* to provide sockets 31*c* which may selectively accommodate the frame brace rod 30. With this construction, the back frame B may be suitably supported, via sockets 31*c* and brace rod 30, in any of a variety of vertically tilted positions, or may be folded down to the nested chain line position shown at B' in FIG. 1. Its adjustment is relative to the seat frame about which it vertically swings.

Provided to support the main frame F, with its associated back rest portion B, at the desired above ground level, are a front leg frame generally designated 32, and a rear leg frame generally designated 33. The rear leg frame 33 is hingedly or pivotally connected to the rails 15 by pins 34, and the front leg frame 32 is similarly hingedly or pivotally connected to the rails 18 at 35. The leg assembly 32 comprises legs 37 connected near their lower ends by a brace rod 36 which may be welded in leg-spanning position. Mounted on the brace rod 36 are a pair of preferably hard plastic, rigid yet spreadable, resilient keeper members 38, in transversely aligned relationship. As FIGS. 7 and 8 particularly illustrate, the lower ends of the keeper members 38 are recessed or slotted as at 38*a* to receive the rails 36 to which they are rigidly joined. Each of the keeper members 38 is configured to provide an upwardly opening, partially closed socket 38*b*, defined by spreadable legs 38*c* and 38*d*, which extend a predetermined distance above the center x of the socket 38*b*. For example, leg 38*c* extends a distance y above the center x, and leg 38*d* extends a distance z above the center x, for a purpose which presently will be described.

The rear leg assembly 33 similarly consists of transversely spaced legs which are identified by the numeral 39, and which similarly have a tubular brace member, identified at 36' since it is identical to brace 36. As FIG. 9 particularly indicates, the pair of keeper members 38' which are provided likewise in fixed position on rail 36 are formed identically to the keeper members 38, and will not be further described. It is to be understood, however, that the keeper members 38' are disposed in opposed position to the members 38, in the sense that the longer legs 38*c'* face forwardly rather than rearwardly. The keeper members 38 and 38' may suitably be formed from a rigid, yet resilient, plastic such as DELRIN homopolymer acetal resin plastic.

Dependent from the inner faces of the support frame side rails 18, are a pair of downwardly extending brackets or plates 40, which are disposed generally intermediate the length of main frame F, forwardly of the hinged connection (25) of the back rest frame B to main frame F.

Figure 7:
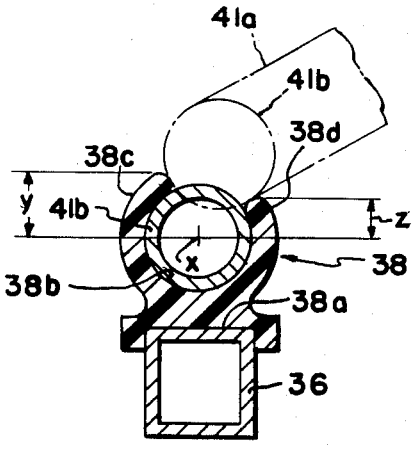
FIG. 7 is a considerably enlarged, fragmentary, transverse sectional view taken on the lines 7—7 of FIGS. 2 and 5, the chain lines illustrating a portion of the brace frame assembly swung down to a position in which it can cam the keeper members to open position.
Figure 8:
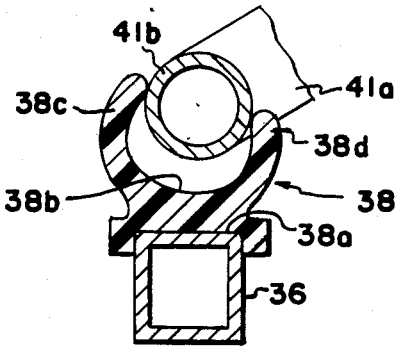
FIG. 8 is a similar view showing the manner in which each of the keeper members is cammed to open position.

A bale-shaped, front leg brace frame, generally designated 41 (see FIGS. 1 and 2), has side legs 41*a* pivotally pinned to the plate 40 at 42, and a mid or web portion 41*b* which, as FIG. 7 indicates, is received within the socket 38*b* of each of the transversely spaced apart keeper members 38.

Similarly, a rear leg brace frame, generally designated 43, has side legs 43*a* pivotally or hingedly pinned to the plates 40 at 44, and a mid or web portion 43*b* which is received within the socket 38*b'* of each of the transversely spaced keepers 38' fixed on the leg brace 36'. The various frame components of the chaise lounge are preferably aluminum parts.

THE OPERATION

Figure 1:
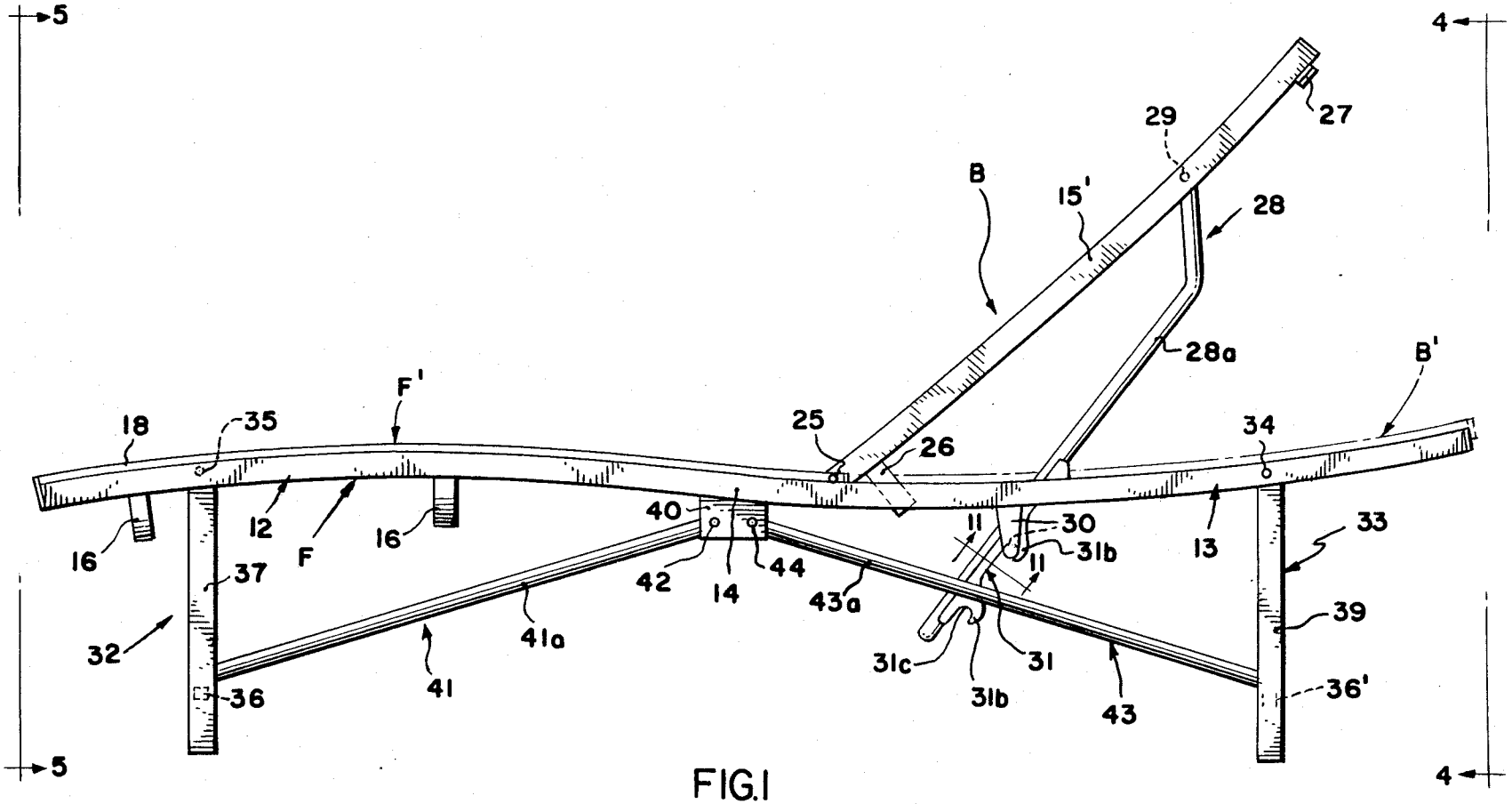
FIG. 1 is a side elevational view of a chaise lounge designed according to the parameters mentioned, the chain lines back rest in fully lowered position.
Figure 2:
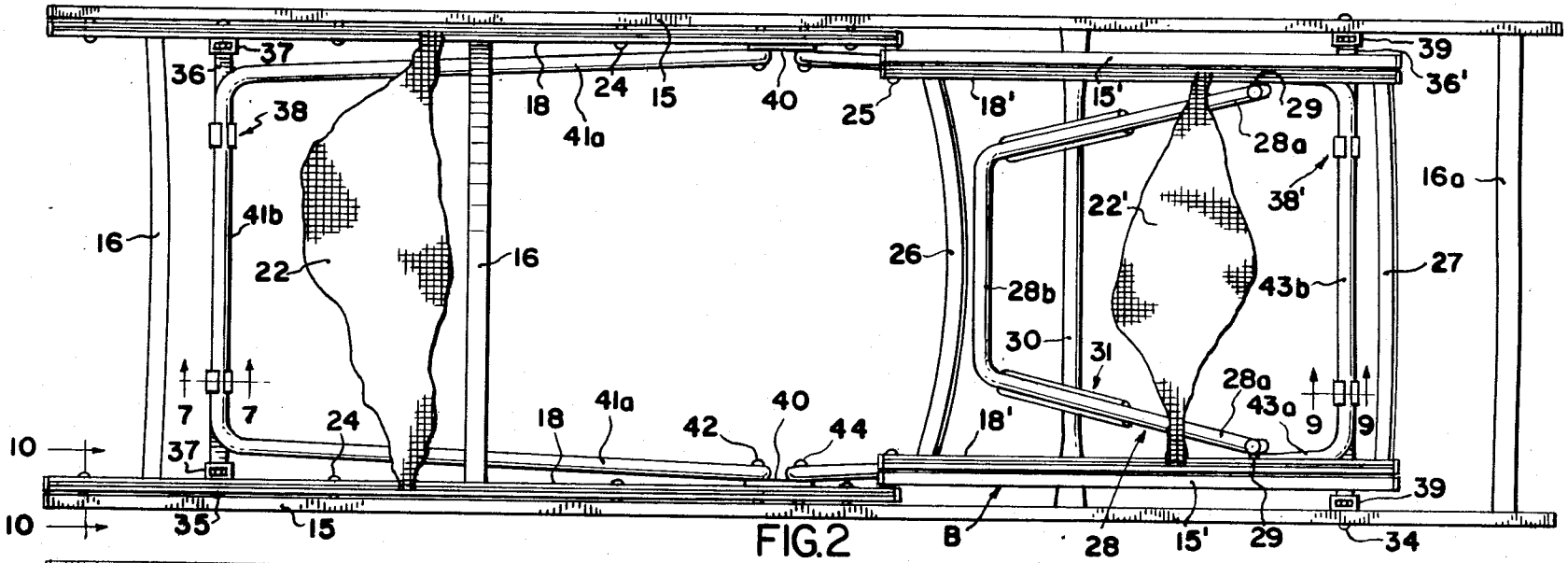
FIG. 2 is a top plan view thereof, with the fabric spanning the leg supporting and back rest framework shown only fragmentarily for purposes of clarity.
Figure 6:
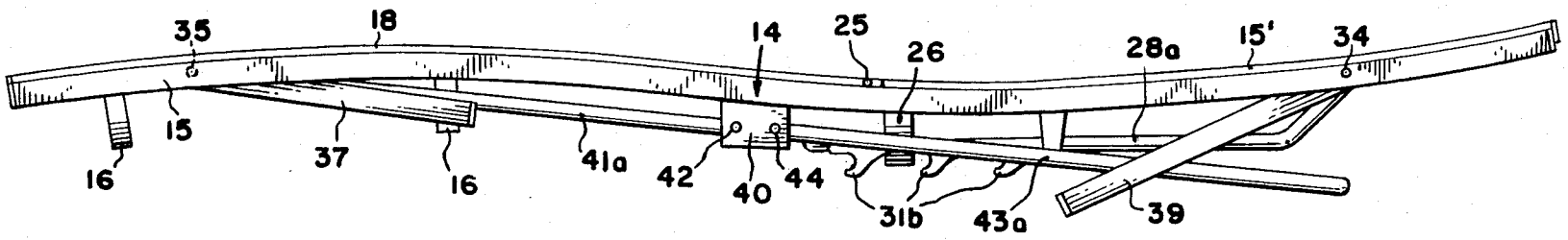
FIG. 6 is a side elevational view similar to FIG. 1, in which various components are shown in a disengaged, folded position.

Assuming that the chaise lounge has been received in the folded condition indicated in FIG. 6, and it is desired to dispose it in the engaged condition shown in FIG. 1, leg assembly 32 will first be swung to the vertical position shown in FIG. 1, and front leg brace assembly 41 will then be pivoted down to the position illustrated in FIG. 7 by the chain lines. With the parts so disposed, the upper end of the leg 38*c* of each keeper 38, will first be engaged by the interengaging mid-portion 41*b* of brace frame 41. With the leg assembly 32 held in one hand, and the brace 41 in the other, further downward movement of the mid-portion 41*b* can readily be accomplished and results in spreading the legs 38*c* and 38*d* of the rigid keeper members 38 in the manner illustrated in FIG. 8, such that the rod portion 41*b* can be received between them and pass into sockets 38*b*, whereupon the legs 38*c* and 38*d* snap back to the normal unbiased position illustrated in FIG. 7. Because leg 38*c* is the longer leg, and the arms 41*a* of the brace assembly 41 swing in an arc the distances y and z are instrumental in providing the proper spreading action of both arms 38*c* and 38*d*.

Figure 9:
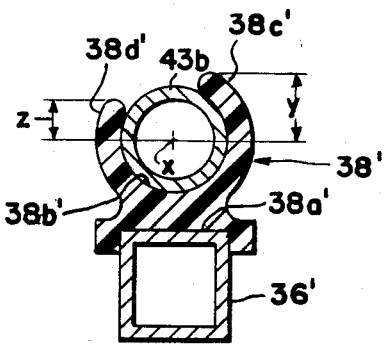
FIG. 9 is a view similar to FIG. 7, but taken on the lines 9—9 of FIGS. 2 and 4.

As FIG. 9 well indicates, the keepers 38' operate to receive the brace rods 43*b* in exactly the same manner, because legs 38*c'*, which are the longer legs, face forwardly.

Assuming the brace frames 41 and 43 to be in the interengaged positions, shown in FIG. 1, compactive folding of the chaise lounge involves as a first step the disengagement of brace frames 41 and 43, which is readily accomplished by simply moving the brace frames 41 and 43 upwardly to disengage the members 41*b* and 43*b* from the keeper members 38 and 38'. This is best accomplished by disengaging first one, and then the other of the brace frames 41 and 43 and can be accomplished by holding a leg frame 32 or 33 in one hand, while moving the associated brace frame 41 or 43 upwardly with the other. With disengagement of the brace frames 41 and 43, it is a simple matter to pull them upwardly toward the main frame F, and then to swing the leg sections 32 and 33 upwardly to the main frame F. Prior to, or after, doing this, the back B will be preferably lowered to the reclined position disclosed at B' in FIGS. 1 and 6. It will be noted that the back components in lowered position next with the leg frames 32 and 33 and brace frames 41 and 43.

With the center of gravity of a reclining occupant located substantially at plates 40, the vertical force exerted by the weight of the occupant is such, with the present construction, as to minimize any tendency of the leg assemblies 32 and 33 to buckle forwardly and rearwardly respectively. Thus, very rigid construction is presented, which provides the rugged appearance of non-foldable furniture, while still providing foldability for storage purposes.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

I claim:

1. A chaise lounge frame comprising: a longitudinally disposed, open framework, main frame comprising a rear back support portion integrated with a front leg support portion; a back rest portion having a lower end hingedly supported by the main frame generally intermediate the length of the main frame and pivotal from a longitudinal position generally in the plane of the main frame to a vertically inclined position; a front leg frame, including legs connected by a cross member, hingedly connected to said leg support portion of the main frame generally at the front of the main frame and swingable from a vertical position upwardly to a generally longitudinal position folded toward said leg support portion; a rear leg frame, including legs connected by a cross member, hingedly connected to said back support portion of the main frame generally at the rear of the main frame and swingable from a vertical position upwardly to a generally longitudinal position folded toward said back support portion; a front leg brace frame, including rigid, non-foldable brace legs, hingedly connected to said main frame generally intermediate the length of said main frame to extend in one position at a longitudinally downwardly inclined angle and having its front end, engageable with and disengageable from said front leg frame, and swingable upwardly and forwardly when disengaged from said front leg frame to a generally longitudinal position folded toward said front leg support portion of the main frame; a rear leg brace frame, including rigid non-foldable brace legs, hingedly connected to said main frame generally intermediate the length of said main frame to extend in one position at a downwardly inclined angle and having a rear end, engageable with and disengageable from said rear leg frame, and swingable upwardly and rearwardly when disengaged from said rear leg frame to a generally longitudinal position folded toward said back support portion of the main frame; socket means, comprising a base with upwardly open, spreadable trap fingers extending upwardly from the base and providing a narrowed socket means entrance, provided on at least one of said leg frame cross members; one of said brace frames having transversely extending cross piece means configured to be received in said entrance, to spread said trap fingers, and to be disengageably received in said socket means when swung to said angular position; and disengageable means for supporting said back rest portion on various vertically inclined positions.

2. A chaise lounge comprising: a longitudinally disposed, open framework, main frame comprising a rear, back support portion integrated with a front, leg support portion; a seat and leg support assembly comprising side rails, connected by a flexible side rail spanning web, disposed within the main frame and fixed to said main frame; a back rest portion having a lower end hingedly connected to the main frame generally intermediate the length of the main frame and pivotal from a longitudinal position generally in the plane of the main frame to a vertically inclined position; the back rest portion comprising side rails connected by a flexible side rail spanning web; a front leg frame hingedly connected to said leg support portion of the main frame generally at the front of the frame and swingable from a vertical position upwardly to a generally longitudinal position folded toward said leg support portion; a rear leg frame hingedly connected to said back support portion of the main frame generally at the rear of the main frame and swingable from a vertical postion upwardly to a generally longitudinal position folded toward said back support portion; each of said front and rear leg frames having a cross brace transversely spanning side legs; transversely aligned interlock members having upwardly open sockets, mounted on the cross brace; a bracket rigidly dependent from each of said leg support assembly side rails generally intermediate the length of the main frame; a bale-shaped front leg brace frame with side leg portions each pivotally connected to one of said brackets below the level of the main frame and having a side leg portion connecting member disengageably receivable by the sockets on said front leg frame, and swingable upwardly and forwardly when disengaged from the sockets on said front leg frame to a generally longitudinal position folded toward said front leg support portion of the main frame; a bale-shaped rear leg brace frame having side leg portions each pivotally connected to one of said brackets rearwardly of the connection of the front leg brace frame leg portions to the brackets and at the level thereof, and having a side leg portion connecting member disengageably receivable by the sockets on said rear leg frame, and swingable upwardly and rearwardly when disengaged from the sockets on said rear leg frame to a generally longitudinal position folded toward said back support portion of the main frame; a cross member transversely spanning said main frame between the hinged connection of the rear leg frame to the main frame and the hinged connection of the rear leg brace frame to the main frame; and disengageable means comprising a bale-shaped member with leg portions pivotally connected to said back rest portion side rails near the rear ends thereof, the leg portions having a series of vertically spaced downwardly open recesses selectively engageable with said cross member for supporting said back rest portion in various vertically tilted positions; said interlock members comprising rigid trap members providing rigid socket beds, the upper entrance to the sockets being defined by spreadable front and rear rigid fingers having the resiliency to return to position once the connecting member of the brace frame is received in the sockets.

3. The invention of claim 2 wherein the front fingers of the trap members on the front leg frame and the rear fingers of the trap members on the rear leg frame extend above the rear fingers of the trap members on the front leg frame and the front fingers of the trap members on the rear leg frame, respectively.

4. The invention of claim 3 wherein the cross braces transversely spanning the legs of the front and rear leg frames, are spaced a predetermined vertical distance below the level of the pivotal connection of the leg portions of the front and rear leg brace frames to the brackets.

5. The invention of claim 2 wherein said bale-shaped member comprising said disengageable means is configured to nest within the bale-shaped rear leg brace frame when the members are swung toward the main frame.

* * * * *

UNITED STATES PATENT AND TRADEMARK OFFICE

CERTIFICATE OF CORRECTION

PATENT NO. : 4,684,170

DATED : August 4, 1987

INVENTOR(S) : Donald B. Colby

It is certified that error appears in the above-identified patent and that said Letters Patent are hereby corrected as shown below:

Column 2, line 39, insert -- showing the -- after "lines".

Column 5, line 29, change "next" to -- nest --.

Column 6, line 25, change "on" to -- in -- .

Signed and Sealed this

Twenty-fourth Day of November, 1987

*Attest:*

DONALD J. QUIGG

*Attesting Officer*

*Commissioner of Patents and Trademarks*